US006709770B2

(12) United States Patent
Komatsu et al.

(10) Patent No.: US 6,709,770 B2
(45) Date of Patent: Mar. 23, 2004

(54) STEEL SHEET HOT DIP COATED WITH ZN-AL-MG HAVING HIGH AL CONTENT

(76) Inventors: Atsushi Komatsu, 586-1-1-1304, Oda-cho, Izumi-shi Osaka 594-0074 (JP); Nobuhiko Yamaki, 2-38-25, Toriishi, Takaishi-shi Osaka 592-0013 (JP); Atsushi Ando, 4-14-32, Nakasakurazuka, Toyonaka-shi Osaka 561-0881 (JP)

( * ) Notice: Subject to any disclaimer, the term of this patent is extended or adjusted under 35 U.S.C. 154(b) by 0 days.

(21) Appl. No.: 10/203,259

(22) PCT Filed: Feb. 6, 2001

(86) PCT No.: PCT/JP01/00826

§ 371 (c)(1),
(2), (4) Date: Aug. 7, 2002

(87) PCT Pub. No.: WO01/59171

PCT Pub. Date: Aug. 16, 2001

(65) Prior Publication Data

US 2003/0072963 A1 Apr. 17, 2003

(30) Foreign Application Priority Data

Feb. 9, 2000 (JP) ..... 2000-32317

(51) Int. Cl.[7] ..... B32B 15/18; C23C 2/06
(52) U.S. Cl. ..... 428/659; 428/939
(58) Field of Search ..... 428/659, 939, 428/653; 427/433; 148/533, 537; 420/519

(56) References Cited

U.S. PATENT DOCUMENTS 4,609,529 A * 9/1986 Skenazi et al. ..... 420/516
6,235,410 B1 * 5/2001 Komatsu et al. ..... 428/659

FOREIGN PATENT DOCUMENTS

| | | | |
|---|---|---|---|
| EP | 0905270 A2 | * | 3/1999 |
| JP | 64-8702 | | 2/1989 |
| JP | 10-226865 | | 8/1998 |
| JP | 10-306357 | | 11/1998 |
| JP | 11-140615 | * | 5/1999 |
| JP | 11-279732 | | 10/1999 |

OTHER PUBLICATIONS

D.J. Blickwede "55% Al–Zn–Alloy–Coated Sheet Steel" (Oct. 1979).

* cited by examiner

*Primary Examiner*—John J. Zimmerman
(74) *Attorney, Agent, or Firm*—McDermott, Will & Emery

(57) ABSTRACT

A high Al hot-dip Zn—Al—Mg plated steel sheet is obtained by forming on a steel sheet surface a hot-dip plating layer comprising, in mass %, Al: more than 10 to 22% and Mg: 1–5%, and, optionally, Ti: 0.002–0.1%, B: 0.001–0.045% and Si: 0.005–0.5%. The plating layer exhibits a metallic structure of [primary crystal Al phase] mixed in a matrix of [Al/Zn/$Zn_2Mg$ ternary eutectic crystal structure]. Substantially no $Zn_{11}Mg_2$ phase is present in the metallic structure of the plating layer.

4 Claims, 1 Drawing Sheet

STEEL SHEET HOT DIP COATED WITH ZN-AL-MG HAVING HIGH AL CONTENT

TECHNICAL FIELD

This invention relates to a high Al hot-dip Zn—Al—Mg plated steel sheet whose plating layer has an Al content on a level of more than 10 to 22 mass %.

BACKGROUND ART

The good corrosion resistance of hot-dip Zn—Al—Mg plated steel sheets produced using a plating bath containing suitable amounts of Al and Mg in Zn has long made them a focus of various development and research. In the production of hot-dip plated steel sheet of this type, however, spot-like crystal phase appears on the plated steel sheet surface. After standing for a while, the spot portions turn grayish black and give the sheet surface an ugly appearance. Despite being excellent in corrosion resistance, therefore, hot-dip Zn—Al—Mg plated steel sheet has been slow to gain acceptance as an industrial product.

Through extensive studies the inventors ascertained that the spot-like crystal phase is $Zn_{11}Mg_2$ phase. Based on this finding, they defined a metallic structure for a Zn—Al—Mg plating layer containing Al: 4–10% and Mg: 1–4% that inhibits crystallization of the $Zn_{11}Mg_2$ phase and presents a good appearance. They also developed a production method for obtaining the metallic structure. The metallic structure and production method are described in JPA. 10-226865 and JPA. 10-306357.

OBJECT OF THE INVENTION

Thanks to the metallic structure and production method proposed by the inventors, it has become possible to produce industrial-quality hot-dip Zn—Al—Mg plated steel sheet with a plating layer Al content on the 4–10% level that does not have an ugly spotted appearance. However, no study has been reported regarding whether production of such a high-quality hot-dip Zn—Al—Mg plated steel sheet is possible when the Al content is high, e.g., when the plating layer contains Al in excess of 10 mass %. The literature also offers little data regarding the corrosion resistance of hot-dip Zn—Al—Mg plated steel sheet having an Al content in such a high region.

On the other hand, it is known that increasing the Al content of a Zn-base plating offers such advantages as improved heat resistance. This suggest that it could well be worth while to look into the feasibility of developing commercial Zn—Al—Mg plated steel sheet products in the high Al region of an Al content exceeding 10 mass %. In fact, however, little research has been done in this direction.

The reason for this can be traced at least in part to the reported corrosion resistance of Zn—Al plated steel sheet found in outdoor exposure tests. These show that corrosion resistance improves with increasing Al content up to a plating layer Al content of around 10 mass % but then begins to degenerate when the content exceeds about 10 mass %. It was held that the tendency to degenerate in corrosion resistance would continue up to an Al content of approximately 20 mass % (See *Iron and Steel,* 1980, No. 7, p.821–834, FIG. 2). As nothing contrary to this was reported, it came to be considered an established theory. In including Al in a Zn-base plating layer, therefore, the ordinary practice is, from the viewpoint of corrosion resistance (particularly outdoor exposure performance), to avoid the Al content range of approximately 10–20 mass %.

Moreover, when the Al content of the plating layer exceeds 10 mass %, an alloy layer composed mainly of an intermetallic compound between the steel sheet base metal and the plating layer very readily forms. This, too, has hindered development of hot-dip Zn—Al—Mg plated steel sheet in the high Al content region. Formation of this alloy layer markedly degrades plating adhesion, making use in applications where forming property is important difficult.

An object of the present invention is therefore to determine the upper limit of Al content and Mg content in an industrially producible hot-dip Zn-base plating layer and to provide a high corrosion resistance hot-dip Zn—Al—Mg plated steel sheet that, in the high Al content region exceeding 10 mass %, has excellent quality thoroughly capable of standing up to practical use as an industrial product.

DISCLOSURE OF THE INVENTION

An in-depth study carried out by the inventors clarified that, differently from the known corrosion resistance behavior of an Al-containing Zn-base plated steel sheet, the corrosion resistance (particularly the outdoor exposure performance) of a hot-dip Zn—Al—Mg plated steel sheet does not degenerate whatsoever when the Al content of the plating layer exceeds 10 mass %. This corrosion resistance behavior, which is not predictable from conventional knowledge, was concluded to be an effect produced by combined addition of Al and Mg.

In the hot-dip plating layer Al content region of greater than around 5 mass %, the melting point of the plating metal rises with increasing Al content, and the plating bath temperature must be raised proportionally during the plating operation. However, increasing the plating bath temperature shortens the service life of the equipment in the plating bath and tends to increase the amount of dross in the bath. The higher the Al concentration, therefore, the more desirable it is to keep the bath temperature as low as possible, i.e., keep the bath temperature as close to the melting point as possible. From the viewpoint of obtaining a plated steel sheet of good appearance when using a Zn—Al—Mg system, it is important to maintain the metallic structure of the plating layer in the specified form explained in the following. An effective way to achieve this is, it was found, to set the plating bath temperature high, for example, to set a plating bath temperature that is 40° C. or more higher than the melting point. Production of a plated steel sheet with good surface appearance at low cost and high productivity is therefore not easy in the high plating layer Al content region above 10 mass %.

Further study showed that inclusion of suitable amounts of Ti and B in the plating layer markedly inhibited generation of the $Zn_{11}Mg_2$ crystal phase that degrades surface appearance. This led to the discovery that the range of plating bath temperature conditions within which Zn—Al—Mg plated steel sheet with good surface appearance is obtainable can be expanded. Moreover, this effect was found also to be well expressed in the high plating layer Al content region above 10 mass %. In other words, combined addition of Ti and B was found to enable production of hot-dip Zn—Al—Mg plated steel sheet having a plating layer Al content exceeding 10 mass % at a low plating bath temperature closer to the melting point of the plating metal.

Moreover, it was ascertained that inclusion of a suitable amount of Si in the plating layer of a such a high Al hot-dip Zn—Al—Mg plated steel sheet markedly reduces the amount of alloy layer generated and, as such, is highly effective for improving plating adherence. The present invention was accomplished based on the foregoing newly acquired knowledge.

Specifically, the present invention achieves the foregoing object by providing a high Al hot-dip Zn—Al—Mg plated steel sheet obtained by forming on a steel sheet surface a hot-dip plating layer comprising, in mass %, Al: more than 10 to 22%, Mg: 1–5%, Ti: 0.002–0.1% and B: 0.001–0.045%, and, optionally, Si: 0.005–0.5% and the balance of Zn and unavoidable impurities.

As a hot-dip Zn—Al—Mg plated steel sheet enabling a good surface appearance to be obtained with high reliability, the present invention further provides a high Al hot-dip Zn—Al—Mg plated steel sheet obtained by forming on a steel sheet surface a hot-dip Zn-base plating layer of a composition containing, in mass %, Al: more than 10 to 22% and Mg: 1–5%, which plating layer exhibits a metallic structure of [primary crystal Al phase] mixed in a matrix of [Al/Zn/$Zn_2Mg$ ternary eutectic crystal structure]. In a preferred aspect, the present invention provides a plated steel sheet wherein substantially no $Zn_{11}Mg_2$ phase is present in these metallic structures. By "substantially no $Zn_{11}Mg_2$ phase is present" is meant that the $Zn_{11}Mg_2$ phase is not detected by X-ray diffraction.

The invention further provides plated steel sheets having preferable compositions of the hot-dip Zn-base plating layer exhibiting the aforesaid metallic structure. Specifically, the invention provides as four embodiments plated steel sheets whose hot-dip Zn-base plating layer composition comprises:

i) in mass %, Al: more than 10 to 22%, Mg: 1–5% and the balance of Zn and unavoidable impurities,
ii) in mass %, Al: more than 10 to 22%, Mg: 1–5%, Ti: 0.002–0.1%, B: 0.001–0.045% and the balance of Zn and unavoidable impurities,
iii) in mass %, Al: more than 10 to 22%, Mg: 1–5%, Si: 0.005–0.5% and the balance of Zn and unavoidable impurities, and
iv) in mass %, Al: more than 10 to 22%, Mg: 1–5%, Ti: 0.002–0.1%, B: 0.001–0.045%, Si: 0.005–0.5% and the balance of Zn and unavoidable impurities.

PREFERRED EMBODIMENTS OF THE INVENTION

Figure 1:
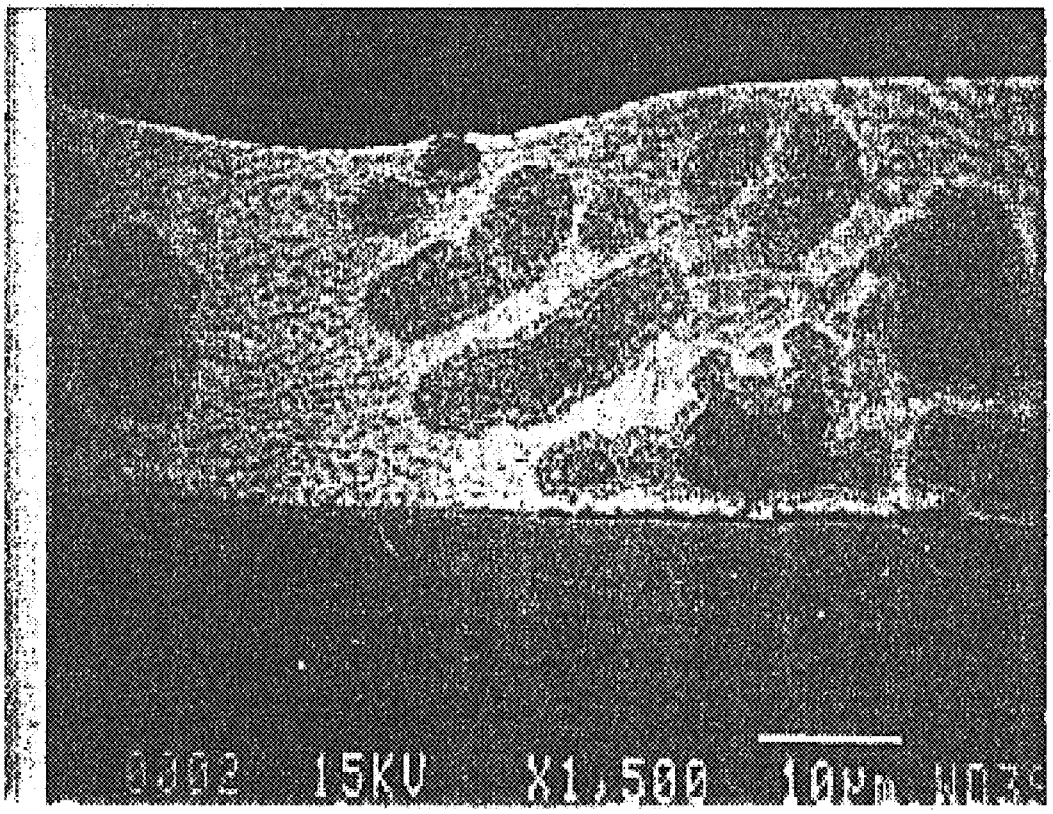
FIG. 1 is an electron (SEM) micrograph of a plating layer cross-section in a high Al hot-dip Zn—Al—Mg plated steel sheet in an example of the present invention, which exhibits a metallic structure composed of [primary crystal Al phase] mixed in a matrix of [Al/Zn/$Zn_2Mg$ ternary eutectic crystal structure].

In the hot-dip Zn—Al—Mg plated steel sheet of this invention, the Al in the plating layer mainly serves to improve the corrosion resistance of the Zn-base plated steel sheet. While conventional wisdom is that a plating layer Al content in the region of 10–20 mass % tends to degrade rather than improve outdoor exposure performance, studies conducted by the inventors showed that, to the contrary, the outdoor exposure performance of a hot-dip Zn—Al—Mg plated steel sheet does not deteriorate in the high Al region exceeding 10 mass %. This point will be demonstrated by Examples set out later in the specification.

As the Al concentration in the Zn-base plating layer increases, the melting point of the plating metal rises on the side of a higher Al content than the eutectic composition in the vicinity of Al: about 5 mass % and the heat resistance increases in proportion. In the region of Al: 10 mass % or less, however, the melting point is low, i.e., the same as or lower than that pure zinc, so that almost no effect of heat resistance improvement is obtained, even relative to ordinary galvanized steel sheet. This invention is therefore directed to a hot-dip Zn—Al—Mg plated steel sheet whose plating layer has an Al content exceeding 10 mass %.

When the Al content of the plating layer exceeds 22 mass %, the melting point becomes 470° C. or higher even when Mg is present. As the plating bath temperature must therefore be increased, the service life of equipment immersed in the bath is shortened and the amount of dross in the bath increases. The pronounced emergence of these and other operational disadvantages makes it difficult to provide Zn-base plated steel sheet at a low cost. This invention therefore defines the upper limit of Al content in the plating layer as 22 mass %.

Mg in the plating layer produces a uniform corrosion product on the plating layer surface to markedly enhance the corrosion resistance of the plated steel sheet. In a Zn-base plated steel sheet whose plating layer has an Al content exceeding 10 mass %, a marked corrosion resistance improving effect is observed when the Mg content of the plating layer is made 1 mass % or greater. When the Mg is included in excess of 5 mass %, however, the corrosion resistance improving effect saturates and, disadvantageously, Mg oxide-system dross generates more readily on the plating bath. The Mg content of the plating layer is therefore defined as 1–5 mass %.

When suitable amounts of Ti and B are added to a Zn—Al—Mg hot-dip plating layer, generation of $Zn_{11}Mg_2$ crystal phase in the plating layer is markedly inhibited. By taking advantage of this knowledge, the plating layer of the aforesaid metallic structure can be formed over a broader range of bath temperature control than when Ti and B are not added, enabling still more advantageous and stable production of hot-dip plated steel sheet that is excellent in corrosion resistance and appearance. Ti and B are preferably added in combination.

When the Ti content of the plating layer is less than 0.002 mass %, the effect of inhibition and growth of $Zn_{11}Mg_2$ phase is not sufficiently manifested. On the other hand, when the Ti content exceeds 0.1 mass %, Ti—Al-system precipitates occur to produce "bumps" (known as "butsu" among Japanese field engineers) in the plating layer that detract from the surface appearance. When Ti is added, the Ti content of the hot-dip plating is therefore set in the range of 0.002–0.1 mass %.

When the B content of the hot-melt plating is less than 0.001 mass %, the effect of inhibiting $Zn_{11}Mg_2$ phase generation and growth by B is not sufficiently manifested. On the other hand, when the B content exceeds 0.045 mass %, Al—B-system and Ti—B-system precipitates occur to produce "bumps" in the plating layer that detract from the surface appearance. When B is added, the B content of the hot-dip plating is therefore set in the range of 0.001–0.045 mass %. Within this range of B content, even when a Ti—B-system compound, e.g., $TiB_2$, is present in the bath, no "bumps" in the plating layer because the size of the compound grains is very small. Therefore, when Ti and B are included in the plating bath, they can be added as Ti, B or Ti—B alloys, or as Zn alloy, Zn—Al alloy, Zn—Al—Mg alloy or Al-alloy containing one or more of these.

Si in the plating layer inhibits generation of an alloy layer between the steel sheet base metal and the plating layer. In the high Al hot-dip Zn—Al—Mg plated steel sheet defined by this invention, the effect of inhibiting the alloy layer is not sufficient when the Si content of the plating layer is less than 0.005 mass %. On the other hand, when Si is included at a content exceeding 0.5 mass %, the aforesaid effect saturates and, in addition, the product quality is degraded by emergence of Zn—Al—Si—Fe-system dross in the bath. When Si is added to the plating layer, therefore, its content is preferably controlled to within the range of 0.005–0.5 mass %.

The metallic structure of the plating layer will now be explained.

As explained in the foregoing, it was found that when a high Al hot-dip Zn—Al—Mg plated steel sheet is produced by forming on the surface of a steel sheet a hot-dip Zn-base plating layer of a composition containing, in mass %, Al: more than 10 to 22% and Mg: 1–5%, its surface appearance and corrosion resistance are degraded when crystallization of $Zn_{11}Mg_2$ occurs. In contrast, a high Al hot-dip Zn—Al—Mg plated steel sheet whose plating layer structure is a metallic structure of [primary crystal Al phase] mixed in a matrix of [Al/Zn/$Zn_2$Mg ternary eutectic crystal structure] is excellent in appearance and also very good in corrosion resistance.

In the metallic structure of [primary crystal Al phase] mixed in a matrix of [Al/Zn/$Zn_2$Mg ternary eutectic crystal structure], the total amount of [Al/Zn/$Zn_2$Mg ternary eutectic crystal structure]+[primary crystal Al phase] is preferably 80 vol. % or greater, more preferably 95 vol. % or greater. The balance can be a mixture of small amounts of Zn single phase, [Zn/$Zn_2$Mg] binary eutectic crystal, $Zn_2$Mg phase and [Al/$Zn_2$Mg] binary eutectic crystal. When Si is added, small amounts of Si phase, $Mg_2$Si phase and [Al/$Mg_2$Si] binary eutectic crystal may also be mixed therein.

FIG. 1 is an electron (SEM) micrograph showing an example of a plating layer cross-section exhibiting a metallic structure composed of [primary crystal Al phase] mixed in a matrix of [Al/Zn/$Zn_2$Mg ternary eutectic crystal structure]. The plating layer of this micrograph is a Ti— and B-added material having a basic composition of Zn—15 mass % Al—3 mass % Mg. The blackish portion at the bottom of the micrograph is the steel sheet base metal. In the metallic structure of the plating layer present on the steel sheet base metal, the eutectic composition of the matrix is the [Al/Zn/$Zn_2$Mg ternary eutectic crystal structure] and the large, blackish island-like portions are the [primary crystal Al phase]. No $Zn_{11}Mg_2$ phase was be observed in the metallic structure by X-ray diffraction.

In the high Al hot-dip Zn—Al—Mg plated steel sheet exhibiting the metallic structure described in the foregoing, the invention defines the plating layer to be a hot-dip Zn-base plating layer of a composition containing, in mass %, Al: more than 10 to 22% and Mg: 1–5%. Although this hot-dip Zn-base plating layer is required to contain 50 mass % or more of Zn, it may, in addition to Al, Mg and Zn, also contain other elements to an extent that does not degrade the basic characteristics of the plated steel sheet that the invention aims to achieve, specifically the corrosion resistance and surface appearance.

For example, the hot-dip Zn-base plating layer may be one containing Ti and B for inhibiting generation of $Zn_{11}Mg_2$ phase, one containing Si for inhibiting alloy layer formation, one containing Ni (which is thought to have an effect of improving corrosion resistance at worked portions) at a content of, for example, 0.1–1 mass %, one containing, for example, 0.001–1.0 mass % of Sr for stabilizing the properties of an oxide coating of the plating layer surface to thereby inhibit "wrinkle-like surface defects," one containing one or more of Na, Li, Ca and Ba (which are thought to have a similar effect) at, for example, a total of 0.01–0.5 mass %, one containing rare earth elements (which are thought to improve plating property and inhibit plating defects) at, for example, a total of 0.0005–1 mass %, one containing Co (which is thought to improve the luster-retention property of the plating surface) at, for example, 0.01–1 mass %, and one containing Sb and Bi (which are thought to improve the intergranular corrosion resistance of the plating layer) at, for example, a total of 0.005–0.5 mass %.

As regards the specific hot-dip Zn-base plating layer, the invention defines the following four composition types:

i) one comprising, in mass %, Al: more than 10 to 22%, Mg: 1–5% and, the balance of Zn and unavoidable impurities, ii) one comprising, in mass %, Al: more than 10 to 22%, Mg: 1–5%, Ti: 0.002–0.1%, B: 0.001–0.045% and the balance of Zn and unavoidable impurities, iii) one comprising, in mass %, Al: more than 10 to 22%, Mg: 1–5%, Si: 0.005–0.5% and the balance of Zn and unavoidable impurities, and iv) one comprising, in mass %, Al: more than 10 to 22%, Mg: 1–5%, Ti: 0.002–0.1%, B: 0.001–0.045%, Si: 0.005–0.5% and the balance of Zn and unavoidable impurities.

These four compositions may, as impurity, include Fe up to about 1 mass which is the Fe content ordinarily allowed in a hot-dip Zn-base plating bath.

The coating weight of the plating is preferably adjusted to 25–300 g/$m^2$ per side of the steel sheet. A plating bath temperature exceeding 550° C. is undesirable because evaporation of zinc from the bath becomes pronounced, making plating defects likely to occur, and the amount of oxide dross on the bath surface increases.

EXAMPLES

Example 1

Hot-dip Zn—Al—Mg plated steel sheets (containing no added T, B or Si) were produced to have various Al and Mg contents using a continuous hot-dip plating simulator (continuous hot-dip plating test line). The plating conditions were as set out below.

Plating Conditions

Processed Steel Sheet:

Cold-rolled, low-carbon, Al-killed steel (Thickness: 0.8 mm)

Running Speed:

100 m/min

Plating Bath Composition (Mass %):

As shown in Table 1

Plating Bath Temperature:

When Al=10.8%: 470° C.

When Al=15.2%: 485° C.

When Al=21.7%: 505° C.

Plating Bath Immersion Time:

2 sec

Wiping Gas:

Air

Coating Weight (Per Side):

60 g/$m^2$

Mean Cooling Rate from Bath Temperature to Plating Layer Solidification Temperature:

4° C./sec

The occurrence of dross in the bath was visually observed during plating with each plating bath and was compared with that in the manufacture of ordinary hot-dip galvanized steel sheet. A bath in which the amount of dross generated was low and about equal to the ordinary level was rated good and assigned the symbol ◎, one that generated a somewhat large amount that was liable to have an adverse effect on the plated steel sheet quality was rated fair and assigned the symbol A, and one that generated a large amount that clearly degraded the quality of the steel sheet and also impeded continuous operation was rated poor and assigned the symbol X. Further, the steel sheets obtained were subjected to a 24-month outdoor exposure test at a seaside industrial area in Sakai City, Japan and the amount of corrosion loss was measured. The results are shown in Table 1.

Although not indicated in Table 1, the metallic structure of the plating layer of each sample was determined to consist of [primary crystal Al phase] mixed in a matrix of [Al/Zn/$Zn_2Mg$ ternary eutectic crystal structure]. All of the steel sheets were good in appearance but some were found to include small amounts of Zn single phase, Zn/$Zn_2Mg$ binary eutectic crystal, Al/$Zn_2$/Mg binary eutectic crystal, $Zn_2Mg$ phase and the like. Invention Examples No. A3–A5, A9–A11 and A15–A17 were examined by X-ray diffraction. Presence of $Zn_{11}Mg_2$ phase was not observed.

TABLE 1

| | Plating layer composition (balance Zn) (mass %) | | | | | Corrosion loss | Dross generation | Example |
|---|---|---|---|---|---|---|---|---|
| No. | Al | Mg | Ti | B | Si | (g/m²) | rating | type |
| A1 | 10.8 | 0 | 0 | 0 | 0 | 8.5 | ◎ | Comparative |
| A2 | 10.8 | 0.5 | 0 | 0 | 0 | 8.1 | ◎ | Comparative |
| A3 | 10.8 | 1.2 | 0 | 0 | 0 | 4.3 | ◎ | Invention |
| A4 | 10.8 | 3.1 | 0 | 0 | 0 | 4.2 | ◎ | Invention |
| A5 | 10.8 | 4.2 | 0 | 0 | 0 | 4.2 | ◎ | Invention |
| A6 | 10.8 | 5.5 | 0 | 0 | 0 | 4.2 | Δ | Comparative |
| A7 | 15.2 | 0 | 0 | 0 | 0 | 10.6 | ◎ | Comparative |
| A8 | 15.2 | 0.5 | 0 | 0 | 0 | 10.1 | ◎ | Comparative |
| A9 | 15.2 | 1.2 | 0 | 0 | 0 | 4.4 | ◎ | Invention |
| A10 | 15.2 | 3.1 | 0 | 0 | 0 | 4.2 | ◎ | Invention |
| A11 | 15.2 | 4.8 | 0 | 0 | 0 | 4.2 | ◎ | Invention |
| A12 | 15.2 | 6.1 | 0 | 0 | 0 | 4.2 | X | Comparative |
| A13 | 21.7 | 0 | 0 | 0 | 0 | 13.1 | ◎ | Comparative |
| A14 | 21.7 | 0.5 | 0 | 0 | 0 | 12.8 | ◎ | Comparative |
| A15 | 21.7 | 1.2 | 0 | 0 | 0 | 4.5 | ◎ | Invention |
| A16 | 21.7 | 3.1 | 0 | 0 | 0 | 4.3 | ◎ | Invention |
| A17 | 21.7 | 4.8 | 0 | 0 | 0 | 4.3 | ◎ | Invention |
| A18 | 21.7 | 5.8 | 0 | 0 | 0 | 4.3 | X | Comparative |

Example 2

Hot-dip Zn—Al—Mg plated steel sheets (containing added Ti and B; no added Si) were produced to have various Al and Mg contents using a continuous hot-dip plating simulator (continuous hot-dip plating test line). The plating conditions were as set out below.

Plating Conditions

Processed Steel Sheet:

Hot-rolled, medium-carbon, Al-killed steel (Thickness: 2.3 mm)

Running Speed:

40 m/min

Plating Bath Composition (Mass %):

As shown in Table 2

Plating Bath Temperature:

When Al=10.5%: 445° C.

When Al=13.9%: 480° C.

When Al=21.1%: 500° C.

Plating Bath Immersion Time:

5 sec

Wiping Gas:

Nitrogen (Oxygen concentration: less than 1%)

Coating Weight (Per Side):

200 g/m²

Mean Cooling Rate from Bath Temperature to Plating Layer Solidification Temperature:

4° C./sec

Occurrence of dross in the bath was evaluated and corrosion loss was investigated by conducting an outdoor exposure test. The methods used were the same as those in Example 1. The results are shown in Table 2.

The metallic structure of the plating layer of each sample was determined to consist of [primary crystal Al phase] mixed in a matrix of [Al/Zn/$Zn_2Mg$ ternary eutectic crystal structure]. All of the steel sheets were good in appearance but some were found to include small amounts of Zn single phase, Zn/$Zn_2Mg$ binary eutectic crystal, Al/$Zn_2$/Mg binary eutectic crystal, $Zn_2Mg$ phase and the like. Invention Examples No. B3–B6, B9–B11 and B15–B17 were examined by X-ray diffraction. Presence of $Zn_{11}Mg_2$ phase was not observed.

TABLE 2

| | Plating layer composition (balance Zn) (mass %) | | | | | Corrosion loss | Dross generation | Example |
|---|---|---|---|---|---|---|---|---|
| No. | Al | Mg | Ti | B | Si | (g/m²) | rating | type |
| B1 | 10.5 | 0 | 0.03 | 0.006 | 0 | 8.5 | ◎ | Comparative |
| B2 | 10.5 | 0.5 | 0.03 | 0.006 | 0 | 8.2 | ◎ | Comparative |
| B3 | 10.5 | 1.2 | 0.03 | 0.006 | 0 | 4.3 | ◎ | Invention |
| B4 | 10.5 | 2.1 | 0.03 | 0.006 | 0 | 4.2 | ◎ | Invention |
| B5 | 10.5 | 3.1 | 0.03 | 0.006 | 0 | 4.2 | ◎ | Invention |
| B6 | 10.5 | 4.1 | 0.03 | 0.006 | 0 | 4.2 | ◎ | Invention |
| B7 | 13.9 | 0 | 0.03 | 0.006 | 0 | 10.1 | ◎ | Comparative |
| B8 | 13.9 | 0.5 | 0.03 | 0.006 | 0 | 9.6 | ◎ | Comparative |
| B9 | 13.9 | 1.2 | 0.03 | 0.006 | 0 | 4.3 | ◎ | Invention |
| B10 | 13.9 | 3.1 | 0.03 | 0.006 | 0 | 4.1 | ◎ | Invention |
| B11 | 13.9 | 4.8 | 0.03 | 0.006 | 0 | 4.2 | ◎ | Invention |
| B12 | 13.9 | 6.1 | 0.03 | 0.006 | 0 | 4.2 | X | Comparative |
| B13 | 21.1 | 0 | 0.03 | 0.006 | 0 | 13.2 | ◎ | Comparative |
| B14 | 21.1 | 0.5 | 0.03 | 0.006 | 0 | 12.1 | ◎ | Comparative |
| B15 | 21.1 | 1.2 | 0.03 | 0.006 | 0 | 4.5 | ◎ | Invention |
| B16 | 21.1 | 3.1 | 0.03 | 0.006 | 0 | 4.3 | ◎ | Invention |
| B17 | 21.1 | 4.8 | 0.03 | 0.006 | 0 | 4.3 | ◎ | Invention |
| B18 | 21.1 | 5.8 | 0.03 | 0.006 | 0 | 4.3 | X | Comparative |

Example 3

Hot-dip Zn—Al—Mg plated steel sheets (containing no added Ti and B; containing added Si) were produced to have various Al and Mg contents using a continuous hot-dip plating simulator (continuous hot-dip plating test line). The plating conditions were as set out below.

Plating Conditions

Processed Steel Sheet:

Cold-rolled, very low-carbon, Ti-added, Al-killed steel (Thickness: 0.8 mm)

Running Speed:

100 m/min

Plating Bath Composition (Mass %):

As shown in Table 3

Plating Bath Temperature:

When Al=10.8%: 470° C.

When Al=15.2%: 485° C.

When Al=21.7%: 505° C.

Plating Bath Immersion Time:

2 sec

Wiping Gas:

Nitrogen (Oxygen concentration: less than 1%)

Coating Weight (Per Side):

100 g/m$^2$

Mean Cooling Rate from Bath Temperature to Plating Layer Solidification Temperature:

4° C./sec

Occurrence of dross in the bath was evaluated and corrosion loss was investigated by conducting an outdoor exposure test. The methods used were the same as those in Example 1. The results are shown in Table 3.

The metallic structure of the plating layer of each sample was determined to consist of [primary crystal Al phase] mixed in a matrix of [Al/Zn/$Zn_2Mg$ ternary eutectic crystal structure]. All of the steel sheets were good in appearance but some were found to include small amounts of Zn single phase, Zn/$Zn_2Mg$ binary eutectic crystal, Al/$Zn_2$/Mg binary eutectic crystal, $Zn_2Mg$ phase, Si phase, $Mg_2Si$ phase, Al/$Mg_2Si$ binary eutectic crystal and the like. Invention Examples No. C3–C5, C9–$C_{11}$ and C15–C17 were examined by X-ray diffraction. Presence of $Zn_{11}Mg_2$ phase was not observed.

TABLE 3

| | Plating layer composition (balance Zn) (mass %) | | | | | Corrosion loss | Dross generation | Example |
|---|---|---|---|---|---|---|---|---|
| No. | Al | Mg | Ti | B | Si | (g/m$^2$) | rating | type |
| C1 | 10.8 | 0 | 0 | 0 | 0.02 | 8.4 | ◎ | Comparative |
| C2 | 10.8 | 0.5 | 0 | 0 | 0.02 | 8.1 | ◎ | Comparative |
| C3 | 10.8 | 1.2 | 0 | 0 | 0.02 | 4.4 | ◎ | Invention |
| C4 | 10.8 | 3.1 | 0 | 0 | 0.02 | 4.2 | ◎ | Invention |
| C5 | 10.8 | 4.2 | 0 | 0 | 0.02 | 4.2 | ◎ | Invention |
| C6 | 10.8 | 5.5 | 0 | 0 | 0.02 | 4.2 | Δ | Comparative |
| C7 | 15.2 | 0 | 0 | 0 | 0.02 | 10.7 | ◎ | Comparative |
| C8 | 15.2 | 0.5 | 0 | 0 | 0.02 | 10.2 | ◎ | Comparative |
| C9 | 15.2 | 1.2 | 0 | 0 | 0.02 | 4.3 | ◎ | Invention |
| C10 | 15.2 | 3.1 | 0 | 0 | 0.02 | 4.2 | ◎ | Invention |
| C11 | 15.2 | 4.8 | 0 | 0 | 0.02 | 4.2 | ◎ | Invention |
| C12 | 15.2 | 6.1 | 0 | 0 | 0.02 | 4.2 | X | Comparative |
| C13 | 21.7 | 0 | 0 | 0 | 0.02 | 13.1 | ◎ | Comparative |
| C14 | 21.7 | 0.5 | 0 | 0 | 0.02 | 12.6 | ◎ | Comparative |
| C15 | 21.7 | 1.2 | 0 | 0 | 0.02 | 4.4 | ◎ | Invention |
| C16 | 21.7 | 3.1 | 0 | 0 | 0.02 | 4.3 | ◎ | Invention |
| C17 | 21.7 | 4.8 | 0 | 0 | 0.02 | 4.3 | ◎ | Invention |
| C18 | 21.7 | 5.8 | 0 | 0 | 0.02 | 4.3 | X | Comparative |

Example 4

Hot-dip Zn—Al—Mg plated steel sheets (containing added Ti, B and Si) were produced to have various Al and Mg contents using a continuous hot-dip plating simulator (continuous hot-dip plating test line). The plating conditions were as set out below.

Plating Conditions

Processed Steel Sheet:

Hot-rolled, low-carbon, Al-killed steel (Thickness: 2.3 mm)

Running Speed:

40 m/min

Plating Bath Composition (Mass %):

As shown in Table 4

Plating Bath Temperature:

When Al=10.5%: 445° C.

When Al=13.5%: 480° C.

When Al=20.1%: 500° C.

Plating Bath Immersion Time:

5 sec

Wiping Gas:

Nitrogen (Oxygen concentration: less than 2%)

Coating Weight (Per Side):

150 g/m$^2$

Mean Cooling Rate from Bath Temperature to Plating Layer Solidification Temperature:

4° C./sec

Occurrence of dross in the bath was evaluated and corrosion loss was investigated by conducting an outdoor exposure test. The methods used were the same as those in Example 1. The results are shown in Table 4.

The metallic structure of the plating layer of each sample was determined to consist of [primary crystal Al phase] mixed in a matrix of [Al/Zn/$Zn_2Mg$ ternary eutectic crystal structure]. All of the steel sheets were good in appearance but some were found to include small amounts of Zn single phase, Zn/$Zn_2Mg$ binary eutectic crystal, Al/$Zn_2$/Mg binary eutectic crystal, Si phase, $Mg_2Si$ phase, Al/$Mg_2Si$ binary eutectic crystal and the like. Invention Examples No. D3–D6, D9–D11 and D15–D17 were examined by X-ray diffraction. Presence of $Zn_{11}Mg_2$ phase was not observed.

TABLE 4

| | Plating layer composition (balance Zn) (mass %) | | | | | Corrosion loss | Dross generation | Example |
|---|---|---|---|---|---|---|---|---|
| No. | Al | Mg | Ti | B | Si | (g/m$^2$) | rating | type |
| D1 | 10.5 | 0 | 0.03 | 0.006 | 0.05 | 8.5 | ◎ | Comparative |
| D2 | 10.5 | 0.5 | 0.03 | 0.006 | 0.05 | 8.2 | ◎ | Comparative |
| D3 | 10.5 | 1.2 | 0.03 | 0.006 | 0.05 | 4.4 | ◎ | Invention |
| D4 | 10.5 | 2.1 | 0.03 | 0.006 | 0.05 | 4.2 | ◎ | Invention |
| D5 | 10.5 | 3.1 | 0.03 | 0.006 | 0.05 | 4.2 | ◎ | Invention |
| D6 | 10.5 | 4.1 | 0.03 | 0.006 | 0.05 | 4.2 | ◎ | Invention |
| D7 | 13.5 | 0 | 0.03 | 0.006 | 0.05 | 10.5 | ◎ | Comparative |
| D8 | 13.5 | 0.5 | 0.03 | 0.006 | 0.05 | 9.9 | ◎ | Comparative |
| D9 | 13.5 | 1.2 | 0.03 | 0.006 | 0.05 | 4.3 | ◎ | Invention |
| D10 | 13.5 | 3.1 | 0.03 | 0.006 | 0.05 | 4.2 | ◎ | Invention |
| D11 | 13.5 | 4.8 | 0.03 | 0.006 | 0.05 | 4.2 | ◎ | Invention |
| D12 | 13.5 | 6.1 | 0.03 | 0.006 | 0.05 | 4.2 | X | Comparative |
| D13 | 20.1 | 0 | 0.03 | 0.006 | 0.05 | 13.5 | ◎ | Comparative |
| D14 | 20.1 | 0.5 | 0.03 | 0.006 | 0.05 | 12.5 | ◎ | Comparative |
| D15 | 20.1 | 1.2 | 0.03 | 0.006 | 0.05 | 4.4 | ◎ | Invention |
| D16 | 20.1 | 3.1 | 0.03 | 0.006 | 0.05 | 4.3 | ◎ | Invention |
| D17 | 20.1 | 4.8 | 0.03 | 0.006 | 0.05 | 4.3 | ◎ | Invention |
| D18 | 20.1 | 5.8 | 0.03 | 0.006 | 0.05 | 4.3 | X | Comparative |

Example 5

Hot-dip Zn—Al—Mg plated steel sheets (containing no added Ti or B) were produced to have various Si contents using a continuous hot-dip plating simulator (continuous hot-dip plating test line). The plating bath had a basic composition of Zn—15.0 mass % Al—3.0 mass % Mg. The plating conditions were as set out below.

Plating Conditions

Processed Steel Sheet:

Cold-rolled, low-carbon, Al-killed steel (Thickness: 0.8 mm)

Running Speed:

100 m/min

Plating Bath Composition (Mass %):

Zn—15.0 mass % Al—3.0 mass % Mg—†Si (†: As shown in Table 5)

Plating Bath Temperature:

470° C.

Plating Bath Immersion Time:

3 sec

Wiping Gas:

Air

Coating Weight (Per Side):

250 g/m$^2$

Mean Cooling Rate from Bath Temperature to Plating Layer Solidification Temperature:

7° C./sec

Occurrence of dross in the bath was evaluated and corrosion loss was investigated by conducting an outdoor exposure test. The methods used were the same as those in Example 1. The results are shown in Table 4.

The mean thickness of the alloy layer of each sample was determined by observing the metallic structure of a plating layer cross-section with an electron microscope (SEM). The results are shown in Table 5. The mean alloy layer thickness of samples whose plating layer had an Si content of 0.05 mass % or greater was less than 0.1 $\mu$m. These samples exhibited high plating adherence and were more than adequate for applications involving heavy working. In the case of Si content of 0.7 mass %, a large amount of Zn—Al—Si—Fe-system dross was generated.

TABLE 5

| Si content of plating layer (†) (mass %) | Mean thickness of alloy layer ($\mu$m) |
|---|---|
| 0 | 5 |
| 0.003 | 3 |
| 0.005 | 0.5 |
| 0.01 | 0.2 |
| 0.05 | Less than 0.1 |
| 0.1 | Less than 0.1 |
| 0.5 | Less than 0.1 |
| 0.7 | Less than 0.1 |

As shown above, the research carried out by the inventors clarified that the outdoor exposure performance of high Al hot-dip Zn—Al—Mg plated steel sheet does not degenerate in the high plating layer Al content region above 10 mass %. It also identified a metallic structure that enables good surface appearance to be obtained with high reliability in such a high Al hot-dip Zn—Al—Mg plated steel sheet. The inventors also ascertained that inclusion of suitable amounts of Ti and B in the plating layer facilitates the hot-dip plating operation by lowering the plating bath temperature and that inclusion of a suitable amount of Si suppresses the amount of alloy layer to ensure good plating adherence. As a result, the adverse effects that increasing the Al content of a Zn—Al—Mg plated steel sheet to a high level has on the plating operation and the quality of the product can be considerably reduced. The present invention therefore makes a major contribution to industrial utilization of high Al hot-dip Zn—Al—Mg plated steel sheet, which has heretofore been considered hard to commercialize.

What is claimed is:

1. A high Al hot-dip Zn—Al—Mg plated steel sheet obtained by forming on a steel sheet surface a hot-dip Zn-base plating layer of a composition comprising, in mass %, Al: more than 10 to 22%, Mg: 1–5%, Si: 0.005–0.5% and the balance of Zn and unavoidable impurities, which plating layer exhibits a metallic structure of primary crystal Al phase mixed in a matrix of Al/Zn/$Zn_2$Mg ternary eutectic crystal structure.

2. A plated steel sheet according to claim 1, wherein substantially no $Zn_{11}$ $Mg_2$ phase is present in the metallic structure of the plating layer.

3. A high Al hot-dip Zn—Al—Mg plated steel sheet obtained by forming on a steel sheet surface a hot-dip Zn-base plating layer of a composition comprising, in mass %, Al: more than 10 to 22%, Mg: 1–5%, Ti: 0.002–0.1%, B: 0.001–0.045%, Si: 0.005–0.5% and the balance of Zn and unavoidable impurities, which plating layer exhibits a metallic structure of primary crystal Al phase mixed in a matrix of Al/Zn/$Zn_2$Mg ternary eutectic crystal structure.

4. A plated steel sheet according to claim 3, wherein substantially no $Zn_{11}Mg_2$ phase is present in the metallic structure of the plating layer.

* * * * *

UNITED STATES PATENT AND TRADEMARK OFFICE

CERTIFICATE OF CORRECTION

PATENT NO. : 6,709,770 B2
DATED : March 23, 2004
INVENTOR(S) : Atsushi Komatsu et al.

It is certified that error appears in the above-identified patent and that said Letters Patent is hereby corrected as shown below:

Title page,
Item [73], Assignee, should read as follows:

Nisshin Steel Co., Ltd.
4-1, Marunouchi 3-Chome Chiyoda-Ku
Tokyo, 100-8366, Japan Signed and Sealed this Sixth Day of July, 2004

JON W. DUDAS
*Acting Director of the United States Patent and Trademark Office*